United States Patent [19]

Bramley

[11] 4,024,906

[45] May 24, 1977

[54] ROTARY REGENERATIVE HEAT EXCHANGER

[75] Inventor: Hugh Christopher Bramley, Coventry, England

[73] Assignee: Caterpillar Tractor Co., Peoria, Ill.

[22] Filed: Dec. 16, 1974

[21] Appl. No.: 533,447

[30] Foreign Application Priority Data

Dec. 14, 1973 United Kingdom ..... 58174/73

[52] U.S. Cl. ..... 165/9; 277/81 R; 277/96

[51] Int. Cl.[2] ..... F28D 19/00

[58] Field of Search ..... 165/9, 7; 277/96, 81 R

[56] References Cited

UNITED STATES PATENTS

| | | | |
|---|---|---|---|
| 3,650,317 | 3/1972 | Barnard et al. | 165/9 |
| 3,692,097 | 9/1972 | Penny | 165/9 |
| 3,719,226 | 3/1973 | Vallance | 165/9 |
| 3,761,101 | 9/1973 | Good et al. | 165/9 X |
| 3,856,077 | 12/1974 | Siegle | 165/9 |
| 3,899,182 | 8/1975 | Johnson | 165/9 X |

*Primary Examiner*—Albert W. Davis, Jr.
*Attorney, Agent, or Firm*—Gifford, Chandler, Sheridan & Sprinkle

[57] ABSTRACT

A rotary regenerative heat exchanger including a rotatable disc-like matrix having an end seal comprising an arcuate portion and a diametral or chord-wise portion each comprising a pressure plate engaging the adjacent end face of the matrix and an axially-compressible resilient member acting between the housing of the heat exchanger and the pressure plate and defining a space internally of the seal portions communicating with a gallery defined by the housing and arranged to receive a pressurized fluid, the pressure plate of the transverse portion being compressively stressed between spaced parts of the pressure plate of the arcuate portion under cold conditions and the length of the pressure plate of the transverse portion being such that the pressure plates of the seal portions are substantially stress-free under hot working conditions.

7 Claims, 9 Drawing Figures

ROTARY REGENERATIVE HEAT EXCHANGER

BACKGROUND OF THE INVENTION

The invention relates to a rotary regenerative heat exchanger of the kind including a rotatable disc-like matrix through which the fluids between which heat is to be exchanged will flow between the end faces of the matrix.

In such a heat exchanger, seals are arranged to engage the end faces of the matrix to define separate portions in each of the end faces through which the respective fluids will flow. It is essential to keep the fluid streams separate because there is a temperature difference between the fluids at at least one end face of the matrix. Futheremore where the heat exchanger is to be employed in a gas turbine engine to exchange heat between hot gases discharged from a turbine and compressed air delivered by a compressor of the engine, there is also a pressure differential between the air and the gas and furthermore leakage of the compressed air to the exhaust gases should be kept to a minimum. The seals are usually resilient and may be internally pressurized to maintain effective contact with the matrix, during the rotation of the matrix relatively to the seals, which are usually stationary, and also to permit relative expansion between the seals and the matrix. Seals used in rotary regenerative heat exchangers of the foregoing kind are often of segmental or D-shape and comprise an arcuate outer portion substantially co-axial with the matrix and a diametral or chord-wise portion co-operating with the arcuate portion to define a closed area or areas of segmental shape. Known seals of this kind either have intergral arcuate and transverse portions or separate arcuate and transverse portions. An object of the invention is to provide in a rotary regenerative heat exchanger of the foregoing kind at at least one end of the matrix thereof a seal comprising arcuate and transverse portions arranged to permit effective sealing to be maintained and to be substantially stress-free when hot despite relative expansion between the arcuate and transverse seal portions.

SUMMARY OF THE INVENTION

According to the invention, a rotary regenerative heat exchanger including a rotatable disc-like matrix having heat-exchange passages extending between the end faces thereof has at least one end thereof a seal comprising an arcuate portion substantially co-axial with the matrix and a transverse portion extending diametrically or chord-wise of the arcuate portion, the seal portions being located in a housing containing the matrix and each comprising a pressure plate engaging the adjacent end face of the matrix and an axially-compressible resilient member acting between the housing and the pressure plate and defining a space internally of the seal portion and communicating with that of the other seal portion and with a gallery defined by the housing and arranged to receive a pressurised fluid, end parts of the pressure plate of the transverse portion being compressively stressed between diametrically or chord-wise spaced parts of the arcuate portion under cold conditions but the length of the pressure plate of the transverse portion being such that the pressure plate of the seal portions are substantially stress-free under hot working conditions.

In a preferred construction, the axially-compressible resilient member of the transverse portion together with the associated pressure plate defines a tube communicating at its ends with the gallery in the housing, and the resilient member of the arcuate portion is in the form of an arcuate trough having its mouth facing radially outward and communicating with the gallery in the housing along substantially the whole length of the arcuate portion.

The axially-compressible resilient members of the transverse and arcuate portions of the or each seal may be integral or secured together and define a continuous space internally thereof extending throughout the whole seal and open to the gallery in the housing around the whole periphery of the seal.

BRIEF DESCRIPTION OF THE DRAWINGS

By way of example, two embodiments of an end seal for a rotary regenerative heat exchanger of the foregoing kind are now described with reference to the accompanying drawings, in which.

DESCRIPTION OF THE PREFERRED EMBODIMENTS

Figure 5:
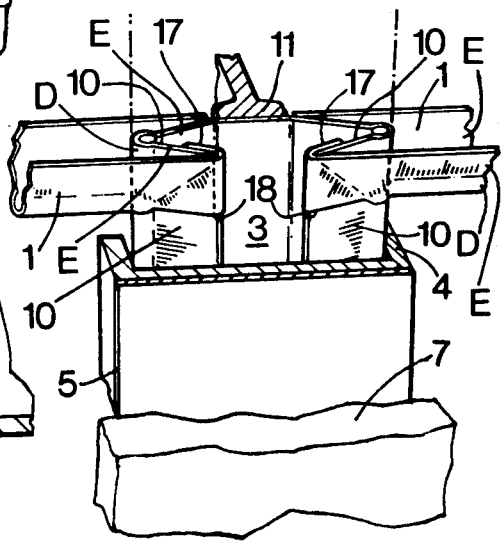
FIG. 5 is a perspective diagram showing the junctions between arcuate portions and the diametral portion of the seal to a considerably larger scale than that employed in FIG. 1.
Figure 9:
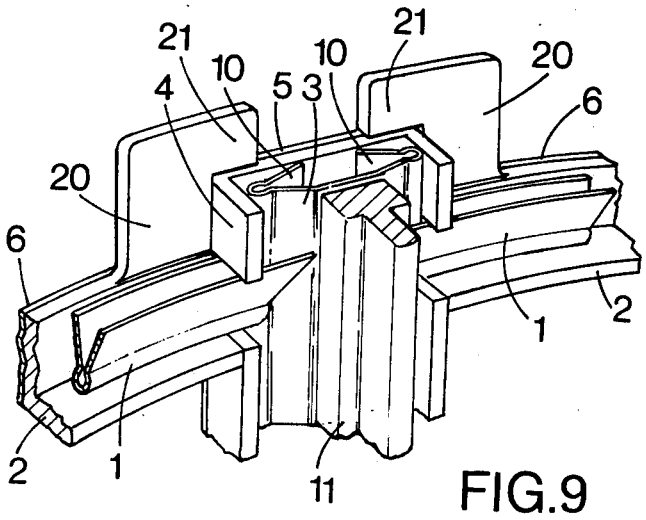
FIG. 9 is a perspective diagram of the first embodiment of seal showing the interconnection between the ends of the arcuate portions and the diametral portion of the seal to a considerably larger scale than that employed in FIG. 1.

Referring firstly to FIGS. 1 to 5, 8 and 9, the first seal employed at each end of a disc-like matrix 7 comprises two substantially semi-circular portions 1 and a diametral portion 3. The diametral portion 3 comprises a channel-shaped member of springy metal resilient in the axial direction of the matrix 7 and having inwardly directed rim portions 10 (see FIGS. 3, 5 and 9) abutting against a channel-shaped pressure plate 4 slidably engaging the end face of the matrix 7 along a diametral region thereof. The surface of the pressure plate 4 which engages the end face of the matrix 7 is formed with a rubbing layer 5 as shown in FIGS. 5 and 9. The base of the channel of the portion 3 abuts against a wall 11 extending along a diameter of a housing part 8 which together with a similar housing part 9 contains the matrix and the seals. The wall 11 divides the housing diametrically. A similar diametral wall 12 is provided in the housing part 9 at the other end of the matrix 7. The housing parts 8 and 9 together define a gallery 13 coaxially around the periphery of the matrix 7. The gallery 13 is supplied with a compressed fluid, for example compressed air bled from the compressor delivery duct of a gas turbine engine including the heat exchanger. The compressed fluid fills the tubular space defined by the channel of the portion 3 and the pressure plate 4 and thereby supplements the resilience afforded by the resilient portion 3 to urge the pressure plate 4 into sealing engagement with the end face of the matrix 7 and the base of the channel of portion 3 against the wall 11.

Each semi-circular portion 1 of the seal is in the form of a semi-circular trough formed of springy metal and this is wedged between a pressure plate 2 slidably engaging the respective end face of the matrix 7 and the housing part 8 or 9. The surface of the pressure plate 2 which engages the end face of the matrix 7 is formed with a rubbing layer 6. The mouth of the trough is open to the gallery 13 along the whole circumferential length of the seal and therefore the interiors of the seal portions are pressurized and the sides of the troughs are held by the resilience of the resilient portions 1, supplemented by the internal pressurization, in sealing engagement respectively with the adjacent pressure plate 2 and the housing part 8 or 9.

Figure 1:
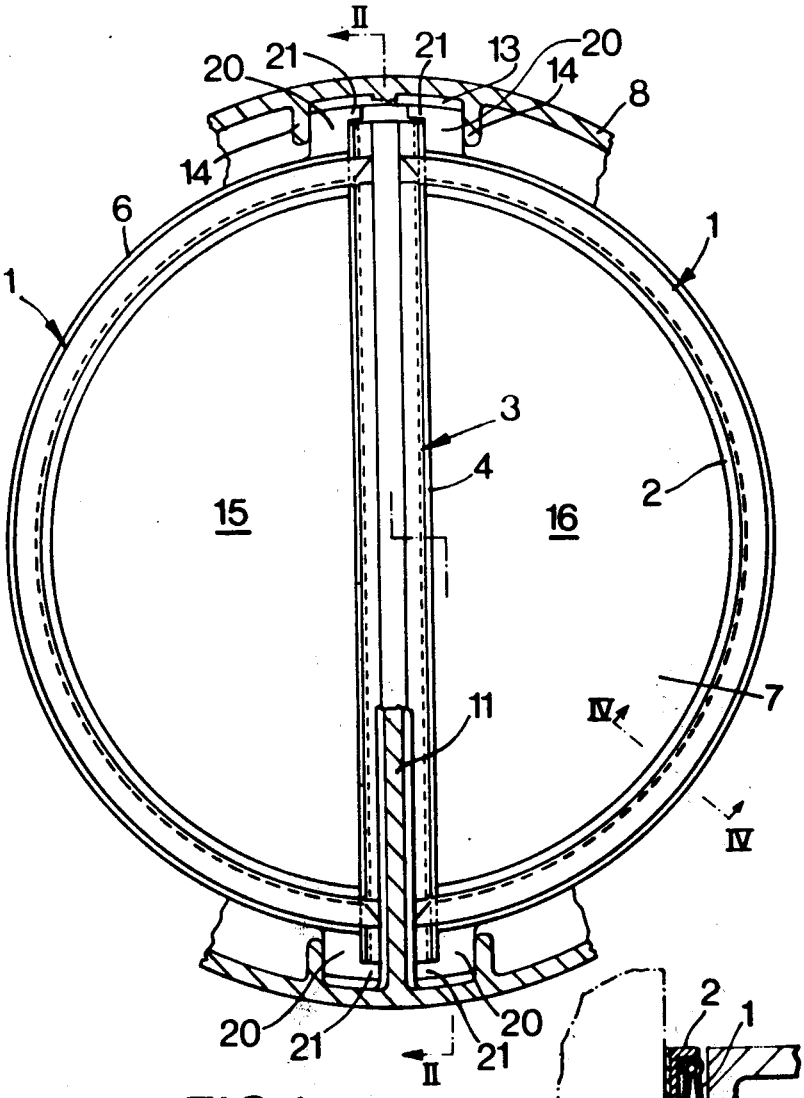
FIG. 1 is an end view of the seal and matrix of the first embodiment of seal from one end of the matrix and shows part of the matrix housing in cross-section.
Figure 4:
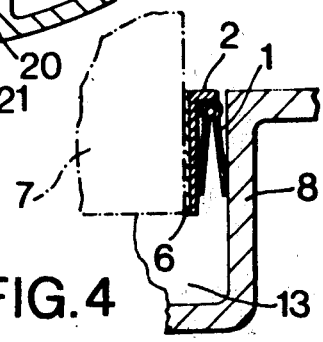
FIG. 4 is a scrap section to a larger scale on the line IV—IV in FIG. 1.
Figure 2:
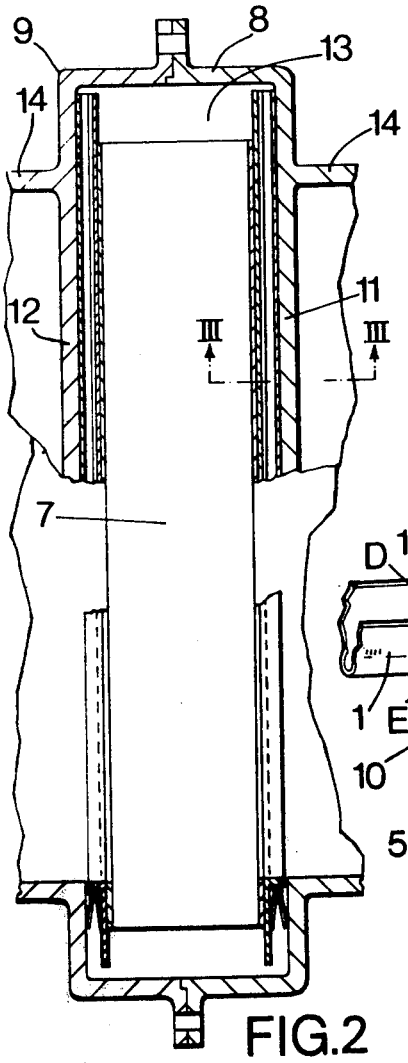
FIG. 2 is a section on the line II—II in FIG. 1.
Figure 3:
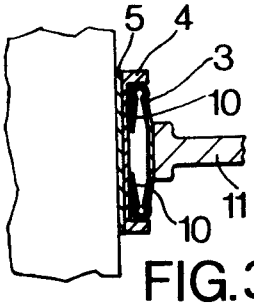
FIG. 3 is a scrap section to a larger scale on the line III—III in FIG. 2.

The arcuate pressure plates 2 and the diametral pressure plate 4 are formed separately. Although the diametral pressure plate 4 may be substantially hotter than the arcuate pressure plate 2 during running of the gas turbine engine, of which the heat exchanger is a component, a temperature gradient is induced in the arcuate pressure plates 2, the inner radius of each arcuate pressure plate being hotter than the outer radius thereof. This temperature gradient causes the arcuate pressure plates 2 to expand diametrically by a greater distance than the diametral pressure plate 4. If the arcuate pressure plate 2 and the diametral pressure plate 4 were to be secured together when cold, distortion would occur in the pressure plates when hot, during running of the engine. With a view to reducing such distortion, the pressure plates 2 and 4 are formed separately so that they can expand independently during heating. However when the engine is running, the portion of the seal defining the exhaust gas passage is held in contact with the matrix end face by the surrounding high pressure air. At the points where the pressure plates 2 abut the diametral pressure plate 4, the forces which would be necessary to effect sliding of one on the other against friction would be much greater than those which cause yeilding and distortion of the pressure plates and thus some distortion may occur. To counter this, the arcuate pressure plates 2 are made elliptical, as shown in chain-dotted lines in FIG. 8, the major axis of the ellipse being at right angles to the diametral pressure plate 4 and the ellipticity being such that under running conditions the arcuate pressure plates 2 will become circular as shown in full lines in FIG. 8. The arcuate pressure plates 2 have outwardly-extending lugs 20, see particularly FIG. 9, at their ends located on each side of end portions of the diametral pressure plate 4 and between, as shown in FIG. 1, circumferentially-spaced arcuate walls 14 extending inwardly from the housing parts 8 and 9. The walls hold the assembly of pressure plates 2 and 4 from turning in the housing. As shown in FIG. 9 the lugs 20 of the pressure plates 2 have ears 21 which extend part of the way across the end edges of the diametral pressure plate 4. The length of the diametral pressure plate 4 is so chosen that under hot running conditions, see particularly FIG. 9, the diametral pressure plate is slightly shorter than the diametral distance between the ears 21 on each arcuate pressure plate 2. Under cold conditions as shown in chain-dotted lines in FIG. 8, the arcuate pressure plates 2 cannot contract to their natural positions as this is prevented by the ears 21; but they can contract as much as the shrinkage of the diametral pressure plate 4 permits. Therefore under cold conditions the arcuate pressure plates 2 are stressed (but not sufficiently to cause creep) and the diametral pressure plate is under compression. During running, the arcuate plates 2 and the diametral plate 4 expand together with no relative sliding therebetween to a stress-free hot condition. In this hot condition, the clearances between the end walls 14 and the arcuate plates 2 are very small so that the position of the seal assembly is defined relative to the housing.

The resilient portions 1 and 3 of each seal are attached together to provide a substantially continuous sealing surface throughout the seal by bending one side wall of each portion 1 around the adjacent rim portion 10 of the diametral portion 3, as illustrated at 17 in FIG. 5. As shown in FIG. 5 the edge of each rim portion 10 around which a respective side wall of each portion 1 is bent has a recess 18 substantially corresponding in length to the height of the side wall and in depth to the thickness of the side wall. Therefore the bent portion of the respective side of each portion 1 will be substantially flush with the edge of each rim portion 10. The resilient portions 1 and 3 together tend to conform to the configuration of the pressure plates 2 and 4 under hot conditions and during running are substantially stress-free.

The cross-section shape of each resilient portion 1 and 3 is defined by a part-circular rim D with two outwardly-divergent springy flanges E (see particularly FIG. 5) defining the aforesaid open-mouthed trough.

The arcuate seal portions 1 together with the diametral seal portion 3 of each seal and the associated pressure plates 2 and 4 define a passage 15 for compressed air flowing through the matrix from a compressor to a combustion chamber of a gas turbine engine and a passage 16 for exhaust gases from a turbine of the engine to exhaust. The flow of air and gas through the seals and the matrix 7 may be in opposite axial directions or the same axial directions. The internal pressure and the springy nature of the seal portions 1 and 3 are such that the seal loading in the axial direction is low and therefore wear of the pressure plates 4 and 2 or of the end faces of the matrix 7 is minimal.

Figure 6:
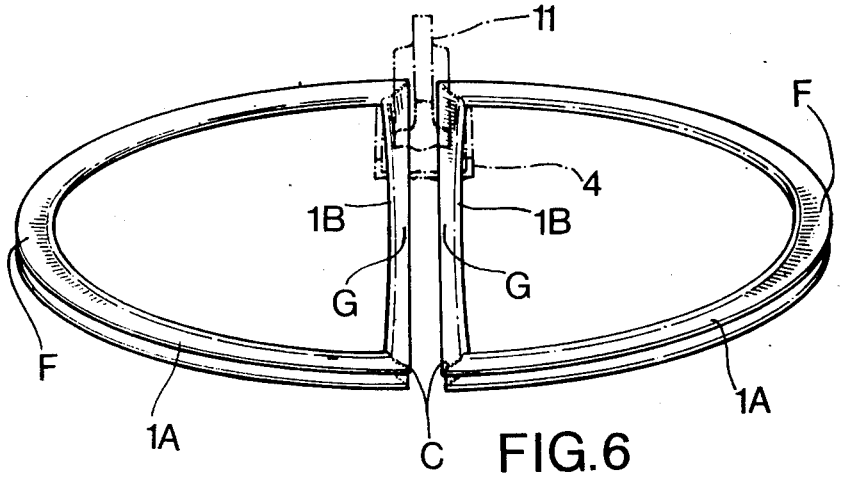
FIG. 6 is a perspective view of portions of a second embodiment of seal.
Figure 7:
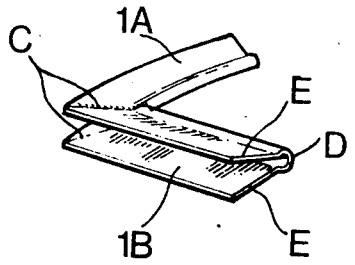
FIG. 7 is an enlarged perspective view of a corner of a seal portion shown in FIG. 6.
Figure 8:
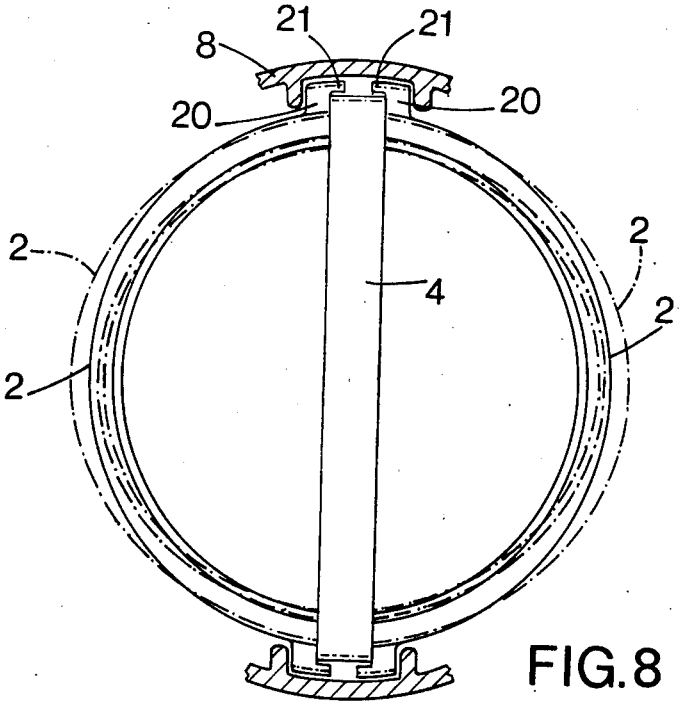
FIG. 8 is an end view similar to FIG. 1 of the first embodiment of seal showing diagrammatically to a smaller scale than that employed in FIG. 1 the seal in the hot and cold positions.

Referring not to FIGS. 6 and 7, in the second embodiment of seal, the axially-compressible resilient arcuate and diametral portions are fomed integrally. A convenient method of construction is to form the resilient seal portions in two D-shaped components each consisting of an arcuate portion 1A and an integral diametral or chord-wise portion 1B secured together at their corners C by brazing or welding along mitred joints, as shown enlarged in FIG. 7. The crosssectional shape of each component is similar to that of the arcuate and diametral axially-compressible resilient portions in FIGS. 1 to 5, that is they have a part-circular rim D with two outwardly-divergent springy flanges E defining an open-mouthed trough, as shown in FIG. 7. The arcuate portions 1A are made radially thicker at their mid-positions F than at the corner joints C and the diametral portions 1B are made thinner at their mid-portions G than at the corner joints C. The purpose of this shaping is to endeavour to ensure that under hot operating conditions, the arcuate portions of the two D-shaped components will tend to remain circular. The two D-shaped components are arranged with their diametral or chord-wise portions 1B side-by-side between the pressure plate 4 and the housing wall 11, partly shown in FIG. 6, and with their arcuate portions 1A between pressure plates 2 and the housing parts 8 or 9, as in the embodiment shown in FIGS. 1 to 5. The interiors of the troughs of the arcuate portions 1A communicate with the gallery 13 formed between the housing parts 8 and 9, as in the embodiment shown in FIGS. 1 to 5. The two diametral or chord-wise portions 1B together with the pressure plate 4 and the housing wall 11 define an open-ended tube communicating at each end with the gallery 13. The construction and arrangement of the pressure plates 4 and 2 in the second embodiment is the same as for the first embodiment shown in FIGS. 1 to 5.

What I claim as my invention and desire to secure by Letters Patent of the United States is:

1. A rotary regenerative heat exchanger including a rotatable disc-like matrix having heat-exchange passages extending between the end faces thereof, the heat exchanger having at at least one end thereof a seal comprising an arcuate portion substantially co-axial with the matrix and a transverse portion extending chord-wise, including diametrically, of the arcuate portion, the seal portions being located in a housing containing the matrix and each comprising a pressure plate engaging the adjacent end face of the matrix and an axially- compressible resilient member acting between the housing and the pressure plate and defining a space internally of the seal portion and communicating with that of the other seal portion and with a gallery defined by the housing and arranged to receive a pressurised fluid, lugs on the pressure plate of the arcuate portion spaced apart chord-wise, including diametrically thereof, said lugs each co-operating with a respective end of the pressure plate of the transverse portion, said chord-wise space between said lugs being less than said chord-wise length of the pressure plate of the transverse portion, whereby the pressure plate of the transverse portion is compressively stressed between the lugs on the pressure plate of the arcuate portion under cold conditions and said chord-wise length of the pressure plate of the transverse portion is such that the pressure plates of the arcuate and transverse portions are substantially stress-free under hot working conditions.

2. A heat exchanger as claimed in claim 1 in which the axially-compressible resilient member of the transverse portion together with the associated pressure plate defines a tube communicating at its ends with the gallery in the housing, and the resilient member of the arcuate portion is in the form of an arcuate trough having its mouth facing radially outward and communicating with the gallery in the housing along substantially the whole length of the arcuate portion.

3. A heat exchanger as claimed in claim 2 in which the axially-compressible resilient members of the transverse and arcuate portions of the seal are secured together and define a continuous space internally thereof extending throughout the whole seal and open to the gallery in the housing around the whole periphery of the seal.

4. A heat exchanger as claimed in claim 2 in which the axially-compressible resilient members of the transverse and arcuate portions of the seal are integral and define a continuous space internally thereof extending throughout the whole seal and open to the gallery in the housing around the whole periphery of the seal.

5. A heat exchanger as claimed in claim 4 in which the seal is formed from two D-shaped components arranged with their transverse portions arranged side-by-side and defining with the respective pressure plates and the housing the complete seal.

6. A heat exchanger as claimed in claim 5 in which the arcuate portion of each D-shaped component is thicker in the radial direction at the mid-point in the length of the arcuate portion than at its junctions with the transverse portion and the transverse portion is thinner at the mid-point in its length than at its junctions with the arcuate portion.

7. A heat exchanger as claimed in claim 2 in which the axially-compressible, resilient members of the arcuate and transverse portions of the seal are of trough-shaped cross-section defined by a part-circular rim portion and a pair of outwardly-divergent, springy flanges.

* * * * *